US009238541B2

(12) United States Patent
Wales et al.

(10) Patent No.: US 9,238,541 B2
(45) Date of Patent: Jan. 19, 2016

(54) BEVERAGE CONTAINER WITH STORAGE COMPARTMENT

(71) Applicants: Lawrence William Wales, Maplewood, MN (US); Joseph Donald Farrell, St. Paul, MN (US)

(72) Inventors: Lawrence William Wales, Maplewood, MN (US); Joseph Donald Farrell, St. Paul, MN (US)

(73) Assignee: Joseph Donald Farrell, St. Paul, MN (US)

( * ) Notice: Subject to any disclaimer, the term of this patent is extended or adjusted under 35 U.S.C. 154(b) by 0 days.

(21) Appl. No.: 14/063,155

(22) Filed: Oct. 25, 2013

(65) Prior Publication Data

US 2014/0183225 A1 Jul. 3, 2014

Related U.S. Application Data

(60) Provisional application No. 61/848,227, filed on Dec. 28, 2012.

(51) Int. Cl.

| | |
|---|---|
| ***B67D 7/74*** | (2010.01) |
| ***B65D 81/32*** | (2006.01) |
| *B65D 23/00* | (2006.01) |

(52) U.S. Cl.

CPC ..... *B65D 81/3211* (2013.01); *B65D 23/003* (2013.01); *B65D 2217/04* (2013.01)

(58) Field of Classification Search

CPC ..... B65D 81/32; B65D 81/3205; B65D 81/3211; B65D 23/003; B65D 25/22; B65D 25/54; B65D 2217/00; B65D 2525/283; B65D 2525/285

USPC ..... 222/129, 562; 206/219, 221; 220/521–526

See application file for complete search history.

(56) References Cited

U.S. PATENT DOCUMENTS

| | | | | | |
|---|---|---|---|---|---|
| 1,029,017 | A | * | 6/1912 | Jones | 220/521 |
| 2,179,095 | A | * | 11/1939 | Kelsey | 43/56 |
| 2,957,609 | A | * | 10/1960 | Holmes | 222/212 |
| 3,039,601 | A | * | 6/1962 | Martin | 206/568 |
| 3,658,204 | A | * | 4/1972 | Bottger | 220/23.4 |
| 4,563,186 | A | * | 1/1986 | Flynn et al. | 8/137 |
| 4,776,972 | A | * | 10/1988 | Barrett | 252/186.38 |
| 4,927,013 | A | * | 5/1990 | Van Brunt et al. | 206/221 |
| 4,955,503 | A | | 9/1990 | Propes | |
| 4,986,322 | A | * | 1/1991 | Chibret et al. | 141/319 |
| 5,209,565 | A | * | 5/1993 | Goncalves | 366/130 |

(Continued)

OTHER PUBLICATIONS

Zing Anything, "Aquazinger," http://zinganything.com/product/aquazinger, at least as early as Aug. 2013, 2 pages.

(Continued)

*Primary Examiner* — Patrick M Buechner

(74) *Attorney, Agent, or Firm* — Leanne Taveggia Farrell; Westman, Champlin & Koehler, P.A.

(57) ABSTRACT

A beverage container includes a primary reservoir adapted to hold a first fluid and a storage compartment located external to the primary reservoir. The primary reservoir is accessible through an opening for filling the primary reservoir with the first fluid and for consuming the first fluid. The beverage container further includes a coupler attached to a wall that defines at least a portion of the storage compartment. The coupler is adapted to mate with a portion of a peripheral container so that the peripheral container is securely housed in the storage compartment. The peripheral container holds a second fluid having a composition that is different from a composition of the first fluid.

18 Claims, 9 Drawing Sheets

(56) References Cited

U.S. PATENT DOCUMENTS

| | | | | |
|---|---|---|---|---|
| 5,984,141 | A | 11/1999 | Gibler | |
| 6,257,428 | B1 | 7/2001 | Caola | |
| 6,705,491 | B1 | 3/2004 | Lizerbram et al. | |
| 6,843,368 | B1 | 1/2005 | Frutin | |
| 7,066,354 | B2 * | 6/2006 | Stank et al. | 222/129 |
| 7,331,483 | B2 | 2/2008 | Bhimani et al. | |
| D639,114 | S | 6/2011 | Swinford et al. | |
| 8,475,856 | B2 | 7/2013 | Sheehan | |
| 2004/0140321 | A1 * | 7/2004 | Stank et al. | 222/129 |
| 2006/0151496 | A1 | 7/2006 | Healy et al. | |
| 2006/0226035 | A1 | 10/2006 | Smith et al. | |
| 2006/0254936 | A1 | 11/2006 | Corbitt et al. | |
| 2008/0000898 | A1 * | 1/2008 | Ramsden | 220/4.26 |
| 2008/0035646 | A1 * | 2/2008 | Smith | 220/526 |
| 2009/0308873 | A1 * | 12/2009 | Kim | 220/524 |
| 2011/0259769 | A1 | 10/2011 | Salinas | |
| 2012/0024812 | A1 | 2/2012 | Underwood | |
| 2014/0186507 | A1 * | 7/2014 | Wales | 426/519 |

OTHER PUBLICATIONS

Copco, "Mix 2 Go," http://www.copco.com/store/site/product.cfm/id/2CEDB810-1E0B-C910-EADC335C91B115D1/fid/2CEDB8AC-1E0B-C910-EAC462FE9B0DDB2E.cfm, at least as early as Aug. 2013, 1 page.

* cited by examiner

BEVERAGE CONTAINER WITH STORAGE COMPARTMENT

CROSS-REFERENCE TO RELATED APPLICATION

The present application is based on and claims the benefit of U.S. provisional patent application Ser. No. 61/848,227, filed Dec. 28, 2012, the content of which is hereby incorporated by reference in its entirety.

BACKGROUND

To enhance a beverage, additives or agents, such as natural and artificial flavorings, natural and artificial colorings, sugars, sweeteners, mineral supplements, vitamin supplements and etc, can be added. One common type of enhanced beverage includes enhanced water. Enhanced water is marketed to improve the health, taste and functional benefits of water.

The discussion above is merely provided for general background information and is not intended to be used as an aid in determining the scope of the claimed subject matter.

SUMMARY

A beverage container includes a primary reservoir adapted to hold a first fluid and a storage compartment located external to the primary reservoir. The primary reservoir is accessible through an opening for filling the primary reservoir with the first fluid and for consuming the first fluid. The beverage container further includes a coupler attached to a wall that defines at least a portion of the storage compartment. The coupler is adapted to mate with a portion of a peripheral container so that the peripheral container is securely housed in the storage compartment. The peripheral container holds a second fluid having a composition that is different from a composition of the first fluid.

In another embodiment, the beverage container includes a through port that extends through the wall and aligns with the coupler. Further, the portion of the peripheral container defines an opening in the peripheral container. The through port provides fluidic communication between the opening in the peripheral container and the primary reservoir to introduce the secondary fluid into the primary fluid.

A method of introducing a secondary fluid into a primary fluid is also described. The beverage container includes a primary reservoir that holds the primary fluid, a storage compartment located external to the primary reservoir, a coupler attached to a wall that defines at least a portion of the storage compartment and a through port extending through the wall that provides fluidic communication between the storage compartment and the primary reservoir. The peripheral container is stored in the storage compartment of the beverage container by mating a portion of the peripheral container that defines an opening in the peripheral container with the coupler. The peripheral container holds the secondary fluid. The secondary fluid located in the peripheral container is dispensed into the primary fluid through the through port by squeezing the peripheral container. The primary fluid has a composition that is different from a composition of the secondary fluid.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
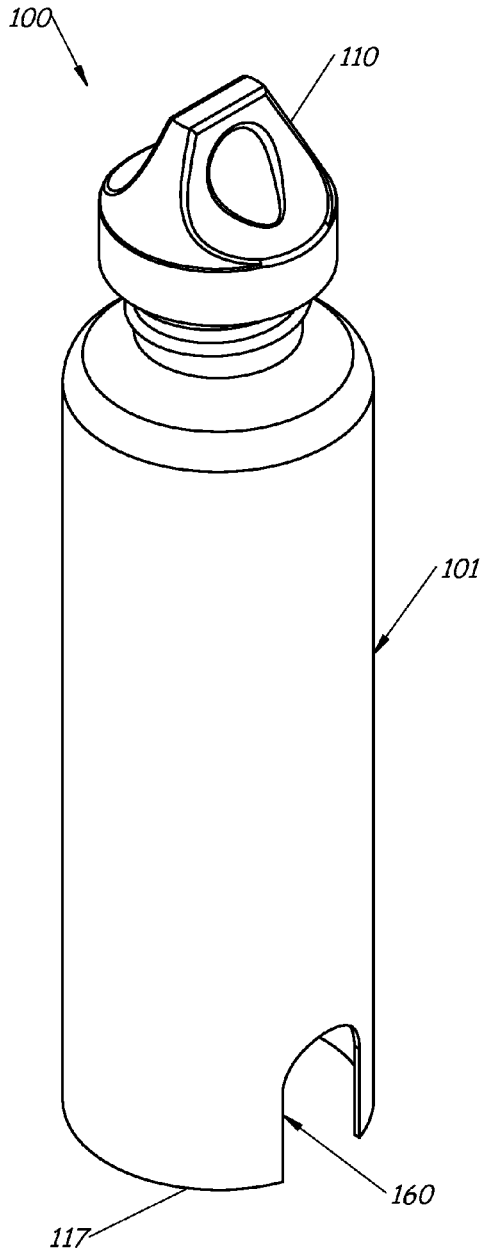
FIG. 1 illustrates a perspective view of a beverage container according to one embodiment.
Figure 3:
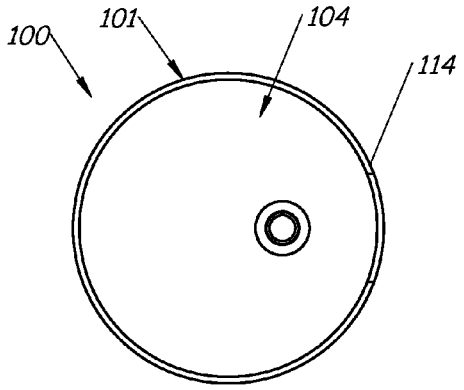
FIG. 3 is a bottom view of the beverage container illustrated in FIG. 1.
Figure 2:
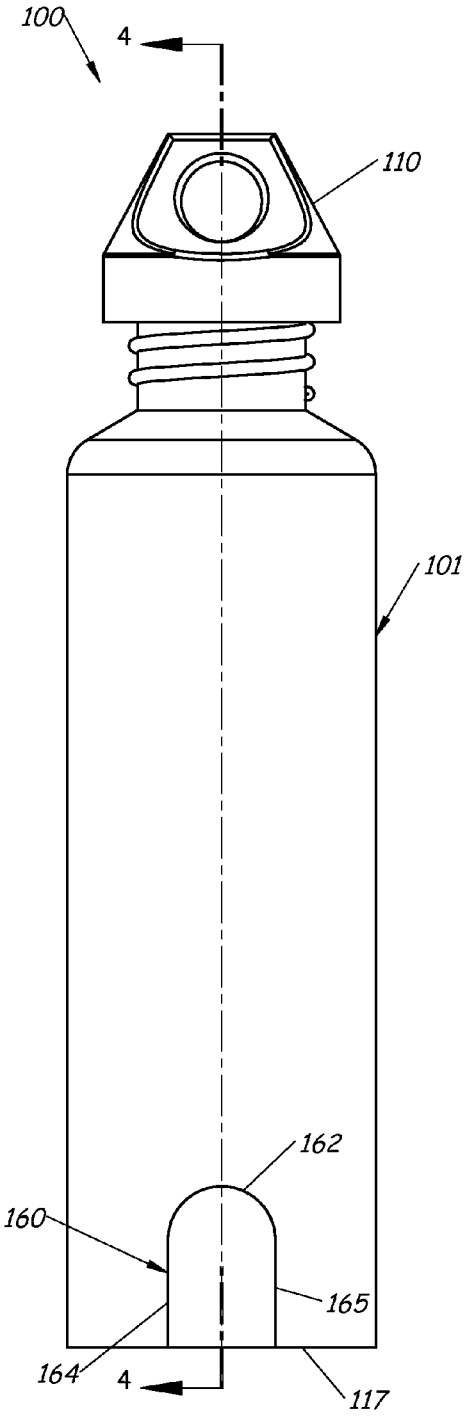
FIG. 2 is a front view of the beverage container illustrated in FIG. 1.
Figure 4:
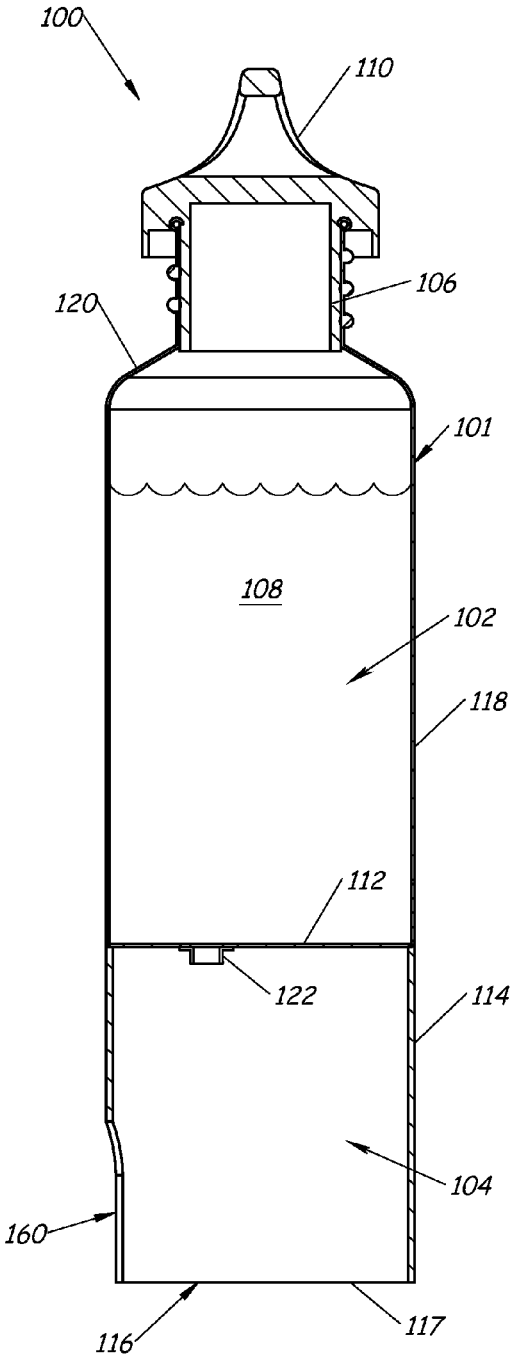
FIG. 4 is a section view of the beverage container illustrated in FIG. 1 take along the line indicated in FIG. 2.

FIG. 1 is a perspective view of a beverage container 100 according to one embodiment. FIGS. 2 and 3 are front and bottom views of beverage container 100 and FIG. 4 is a section view of beverage container 100 taken through the line indicated in FIG. 2. Beverage container 100 includes a main body 101 that is made of a rigid material and has a primary reservoir or holder 102 (FIG. 4) and a storage compartment 104 (FIG. 4) located external to primary reservoir 100.

Primary reservoir 102 includes an opening 106 (FIG. 4) through which primary reservoir 102 can be filled with a first or primary fluid 108 (FIG. 4) and through which first or primary fluid 108 contained in primary reservoir 102 can be consumed by a user. Exemplary kinds of fluids that first fluid 108 may comprise are water and soda. However, other types of fluids including other types of liquid beverages, such as milk, are possible. Beverage container 100 also includes a cap 110 that covers opening 106 in primary reservoir 102. Cap 110 engages with opening 106 in order to contain first fluid 108 within primary reservoir 102 and disengages with opening 106 in order to fill and consume first fluid 108 from primary reservoir 102.

In the embodiment illustrated in FIGS. 1-4, not only is storage compartment 104 located external to primary reservoir 102, but storage compartment 104 is also located below primary reservoir 102. An upper wall 112, a peripheral wall 114 and an open bottom 116 having a bottom free edge 117 define storage compartment 104. In one embodiment, upper wall 112 is a shared wall 112 that also defines a portion of primary reservoir 102. In other words, primary reservoir 102 is defined by shared wall 112 at its bottom, peripheral wall 118 and upper wall 120.

Figure 6:
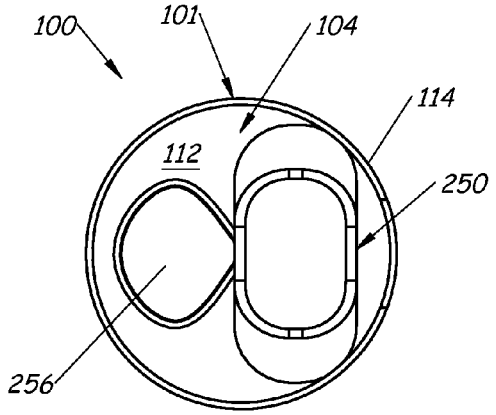
FIG. 6 is a bottom view of FIG. 5.
Figure 5:
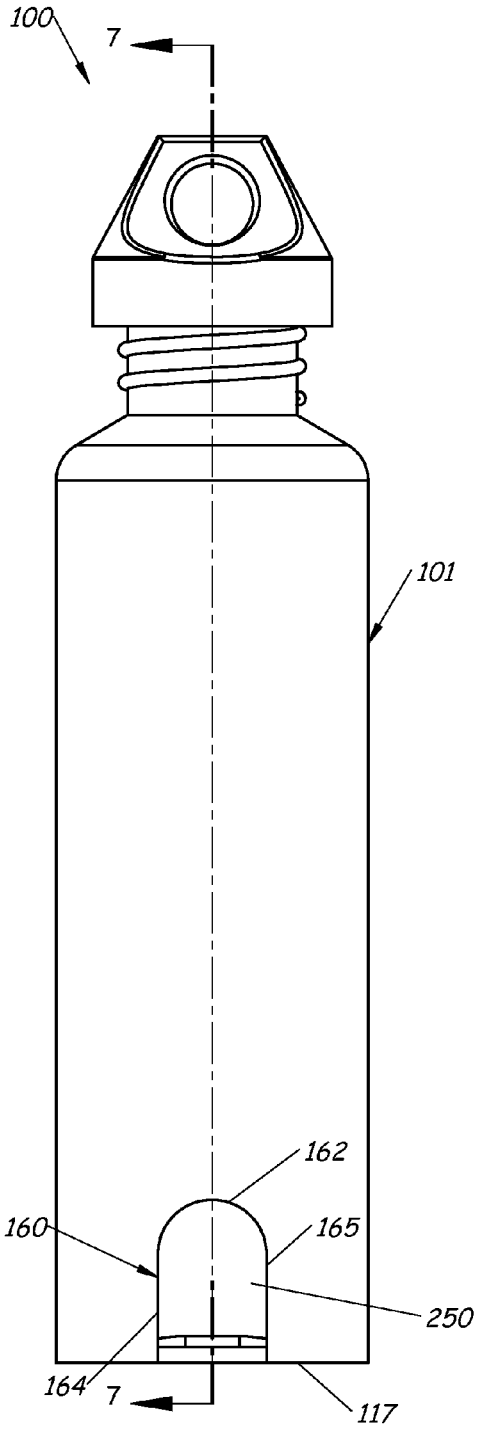
FIG. 5 is a front view of the beverage container illustrated in FIG. 1 with a peripheral container being stored in a storage compartment of the beverage container.
Figure 7:
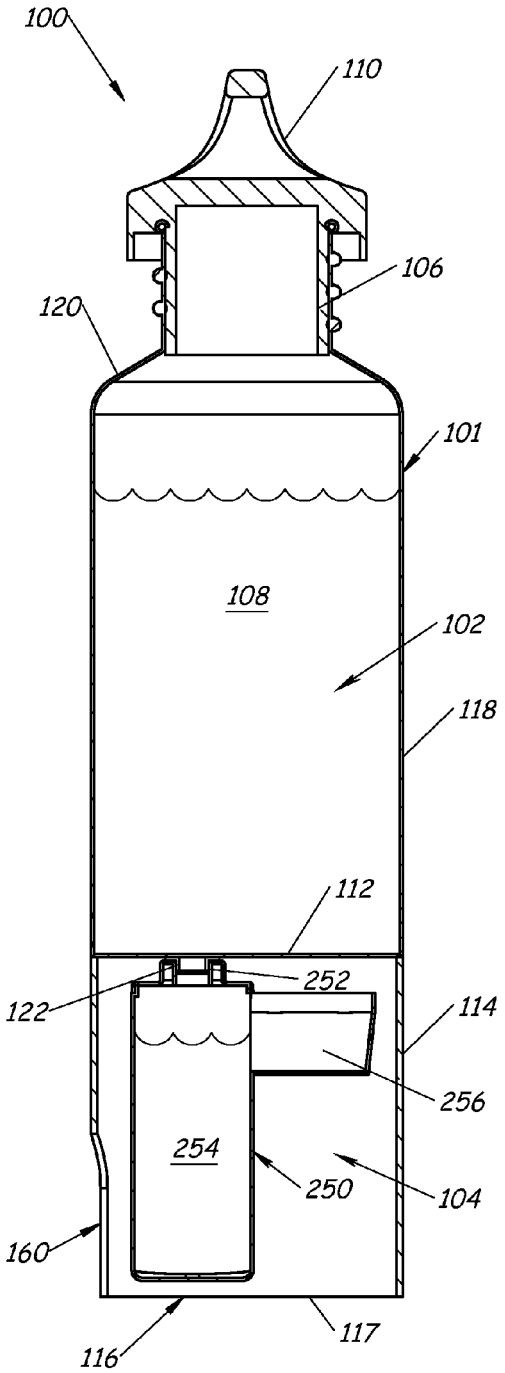
FIG. 7 is a section view of FIG. 5 taken along the line indicated in FIG. 5.

Beverage container 100 further includes a coupler or latching bracket 122. Coupler 122 is attached to, or in alternative embodiments, integrally formed with shared wall 112 and is adapted to mate with a portion of a peripheral container 250 that defines an opening 252 (illustrated in FIG. 7). FIGS. 5-7 illustrate beverage container 100 including a peripheral container 250 that is being stored in storage compartment 104. FIG. 5 is a front view, FIG. 6 is a bottom view and FIG. 7 is a section view taken through the line indicated in FIG. 5. Still further, storage compartment 104 of beverage container includes at least one access opening 160 (additional access openings 160 are possible) that is defined by a radial edge 162 and a pair of side edges 164 and 165. Side edges 164 and 165 are substantially perpendicular to and intersect with bottom free edge 117. Side edge 164 is continuous with radial edge 162 and radial edge 162 is continuous with side edge 165. In the embodiment illustrated in FIGS. 1-7, access opening 160 provides a way for a user to place peripheral container 250 into coupler 122 and to remove or extract peripheral container 250 from coupler 122.

Peripheral container 250 is a container that contains a second fluid or secondary fluid 254 that has a different composition from a composition of first fluid 108. For example, peripheral container 250 includes a liquid beverage mix 254. A beverage mix is a processed food product usually mixed with water to produce a beverage similar to fruit juice or soda. While many beverage mixes come in powdered form, beverage mixes can also be made in the form of concentrated liquid syrup. Concentrated liquid syrup is generally packaged in a container that has an opening 252 and a specialized dispensing nozzle. The specialized dispensing nozzle not only meters a specific amount of the concentrated syrup through opening 252 based on how hard the container is squeezed, but the specialized dispensing nozzle also meters the concentrated liquid syrup through opening 252 so that when the syrup enters the water or other type of liquid, there is minimal splashing. Exemplary liquid beverage mixes that are packaged in these type of containers include, but are not limited to, MiO® by Kraft Foods, Kool-Aid® liquid drink mix, Crystal Light® liquid drink mix, Dasani Drops™ by the Coca-Cola Company. An exemplary dispensing nozzle that is configured to restrict fluid flow from peripheral container 250 to form a jet of concentrated liquid includes a flexible substrate, such as a plate made of silicone or the like, which has a plurality of slits that form flaps. By depressing the sidewall of peripheral container 250, the concentrated liquid is forced against the flexible substrate and outwardly displaces the flaps to allow the concentrated liquid to flow therethrough. Peripheral container 250 is made of a compliant material to allow enough compression to create an internal pressure large enough to expel liquid through a dispensing nozzle and opening 252.

As described above, storage compartment 104 includes open bottom 116 and access opening 160, which allow for the receipt of peripheral container 250. Further, coupler 122, which is pointed downwards toward open bottom 116 from shared wall 112, receives or otherwise mates with a portion of peripheral container 250 that defines opening 252. In this way, coupler 122 secures or holds the peripheral container 250 within storage compartment 104. As illustrated in FIGS. 6 and 7, peripheral container 250 includes a flip top cap 256 that is standard to most containers that contain concentrated liquid beverage mix. In a closed configuration, flip top cap 256 includes a portion that engages with opening 252 to provide protection against leakage through the dispensing nozzle. In an opened configuration, flip top cap 256 is rotatable about a hinge to remove it from opening 252 so that fluid can be dispensed. To affix peripheral container 250 into storage compartment 104, flip top cap 256 is rotated about the hinge to separate it from opening 252 and opening 252 engages with coupler 122 using a press-fit or interference connection. As illustrated in FIGS. 6 and 7, flip top cap 256 can remain connected to the remainder of peripheral container 250 while being housed in storage compartment 104 and, as illustrated in FIGS. 5-7, coupler 122 can include a profile that includes at least a portion that mates with the portion of peripheral container 250 that defines opening 252. However, other ways of connecting coupler 122 to opening 252 are possible.

In the embodiment illustrated in FIGS. 5-7, to mix second fluid or secondary fluid 254 with first fluid or primary fluid 108, cap 110 is removed from opening 106 in primary reservoir 102. Peripheral container 250 is removed from the storage compartment 104 by extracting peripheral container 250 or opening 252 from coupler 122. A user can then dispense secondary fluid 254 by, for example, squeezing the sidewalls of peripheral container 250 so that second fluid 254 meters using the dispensing nozzle, travels through opening 252 in peripheral container 250 and through opening 106 in primary reservoir 102 into first fluid 108 contained in primary reservoir 102.

Figure 8:
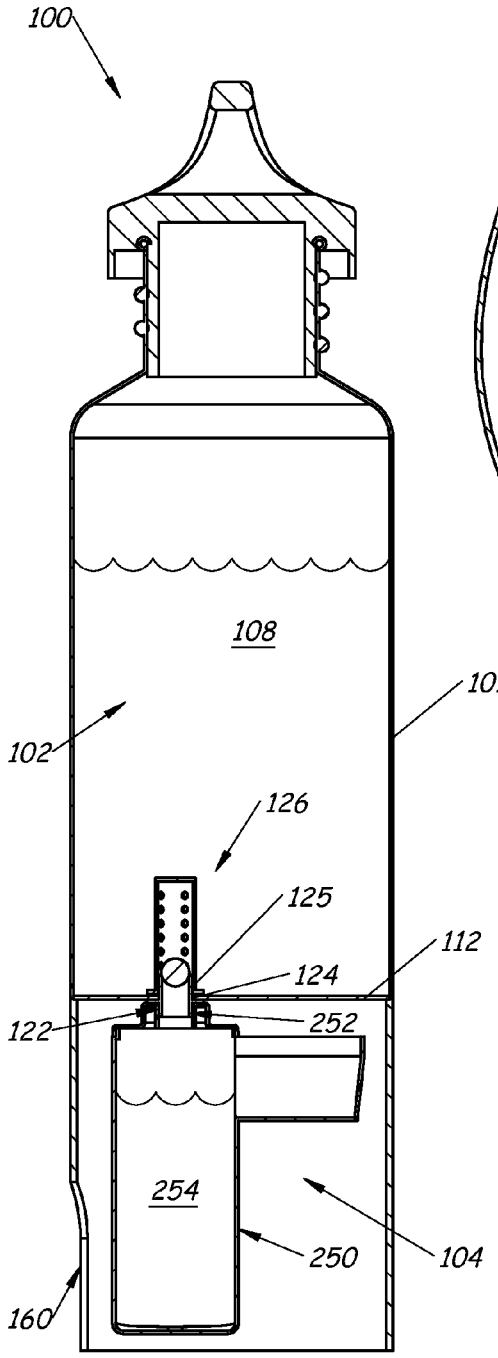
FIG. 8 illustrates a section view of an alternative embodiment of the beverage container illustrated in FIG. 1.
Figure 10:
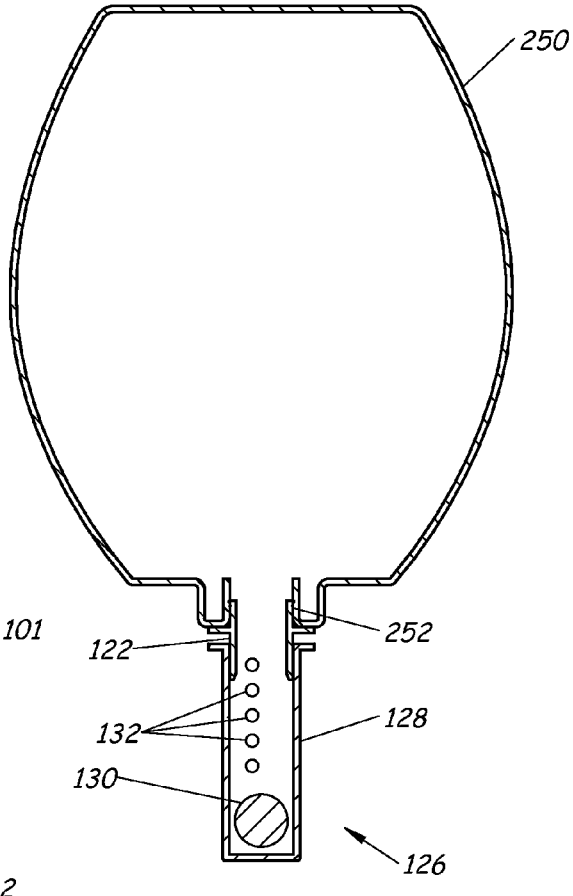
FIG. 10 is a section view of the coupler and the ball stopper illustrated in FIG. 9 including the peripheral container being engaged with the coupler and the beverage container being oriented upside down or inverted for dispensing contents of the peripheral container into the primary reservoir.
Figure 9:
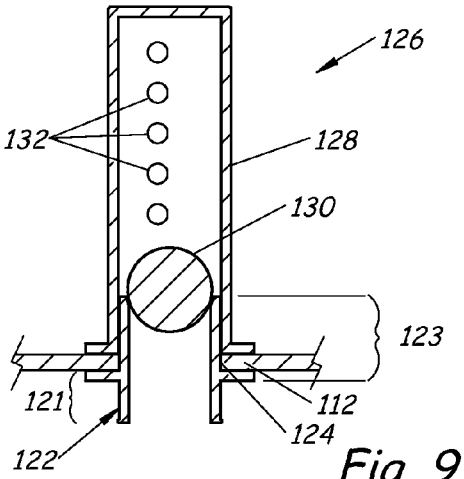
FIG. 9 is an enlarged section view of a coupler and ball stopper of the alternative embodiment illustrated in FIG. 8.

In another embodiment and as illustrated in the section views of FIGS. 8-10, beverage container 100 includes a through port 124 that extends through shared wall 112 that aligns with coupler 122. Through port 124 provides fluidic communication between storage compartment 104 and primary reservoir 102. More specifically, through port 124 provides fluidic communication between peripheral container 250 and primary reservoir 102 to introduce the second fluid 254 into the first fluid 108 without having to remove peripheral container 250 from storage compartment 104. In the embodiment illustrated in FIGS. 8-10, coupler 122 is a separate component that attaches to shared wall 112. In particular, a portion 121 (FIG. 9) of coupler 122 extends downward from shared wall 112 into storage compartment 104 for attaching to opening 252 in peripheral container 250 and a portion 123 (FIG. 9) of coupler 122 extends into through port 124 and into primary reservoir 102. However, other variations of coupler 122 are possible including coupler 122 only having a portion that extends into storage compartment 104 for attaching to opening 252 of peripheral container 250.

Because primary reservoir 102 is located above storage compartment 104, beverage container 100 further includes a valve assembly 126 that prevents first fluid 108 from exiting primary reservoir 102 into through port 124 when beverage container 100 is in the upright position and allows second fluid 254 to be dispensed into first fluid 108 in primary reservoir 102 when beverage container 100 is turned upside down or inverted. Therefore, valve assembly 126 is a one-way valve assembly or check valve.

In one embodiment and as illustrated in FIGS. 9 and 10, valve assembly 126 includes a valve housing 128 and a ball stopper 130. Valve housing 128 surrounds and covers through port 124. In the embodiment illustrated in FIGS. 8-10, valve housing 128 also surrounds portion 123 of coupler 122 that extends into primary reservoir 102. Ball stopper 130, which is made of, for example, a stainless steel or plastic ball, is trapped within valve housing 128 and is used to block the flow of fluid from primary reservoir 102 into peripheral container 250 by sealing over through port 124 in shared wall 112 when beverage container 100 is in the upright position as illustrated in FIG. 9. In FIGS. 8 and 9, ball stopper 130 seals over through port 124 of portion 123 of coupler 122. When beverage container 100 is inverted or flipped upside down, ball stopper 130 releases from through port 124 as illustrated in FIG. 10 and allows fluid to be dispensed from peripheral container 250. More specifically, a user can access side walls of peripheral container 250 through the at least one access opening 160 and open bottom 116 of storage compartment 104 to dispense or squeeze a controlled amount of second fluid 254 into through port 124 and therefore into primary reservoir 102. Still further and in the embodiment illustrated in FIGS. 8-10, valve housing 128 includes one or more dispensing holes 132. Dispensing holes 132 evenly distribute the secondary fluid 254 into primary reservoir 102.

Figure 11:
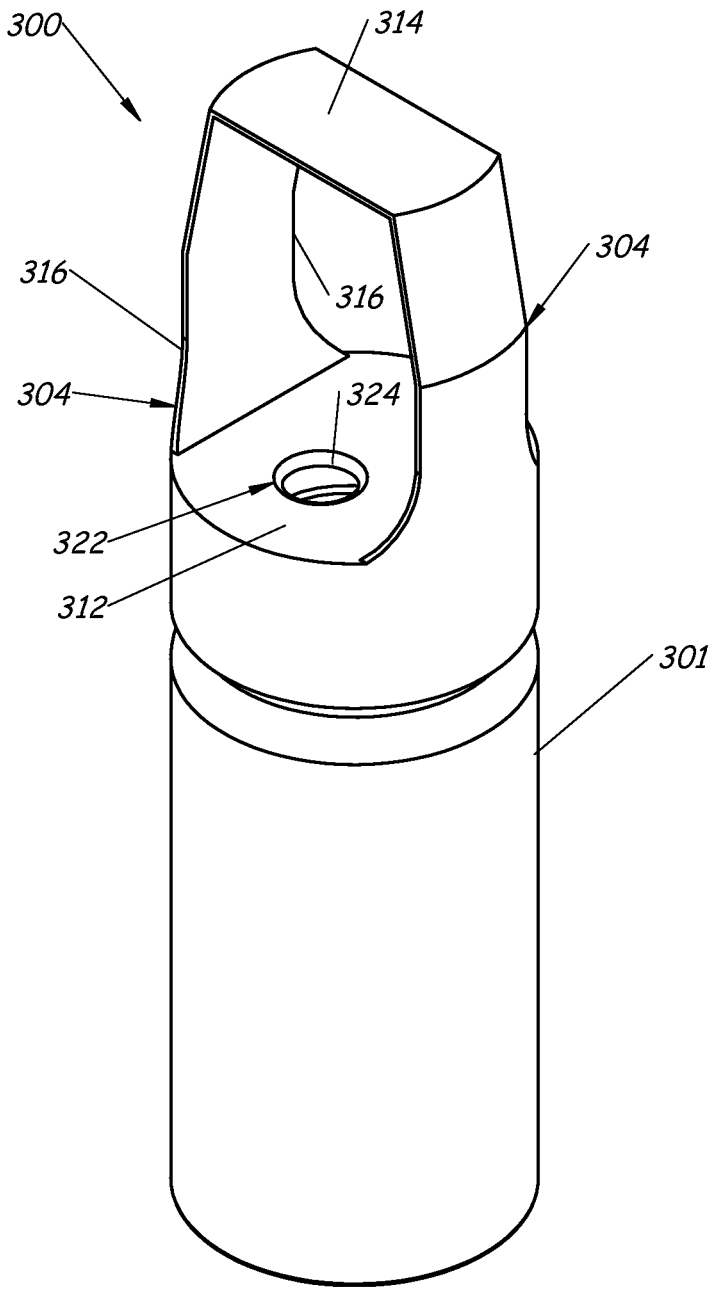
FIG. 11 illustrates a perspective view of a beverage container according to another embodiment.
Figure 12:
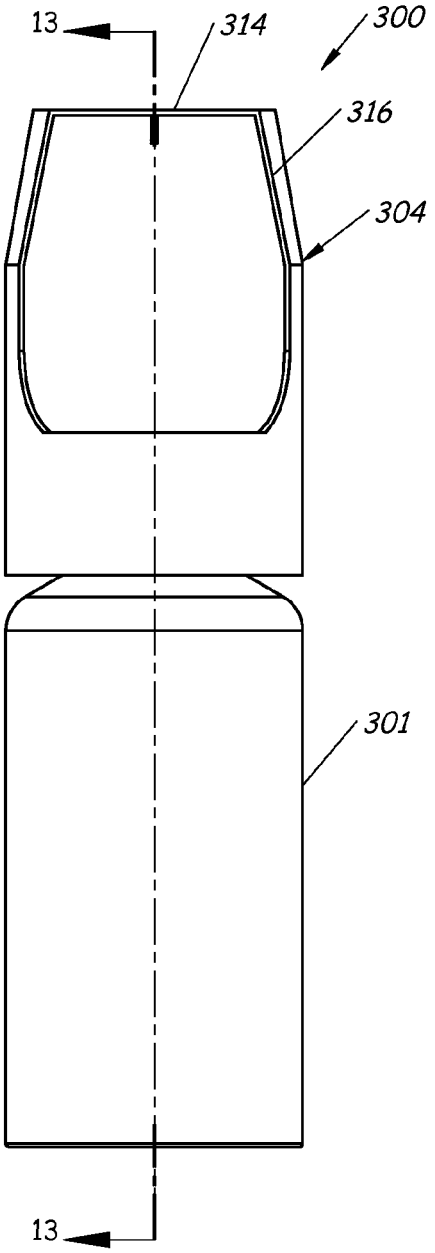
FIG. 12 is a front view of the beverage container illustrated in FIG. 11.
Figure 13:
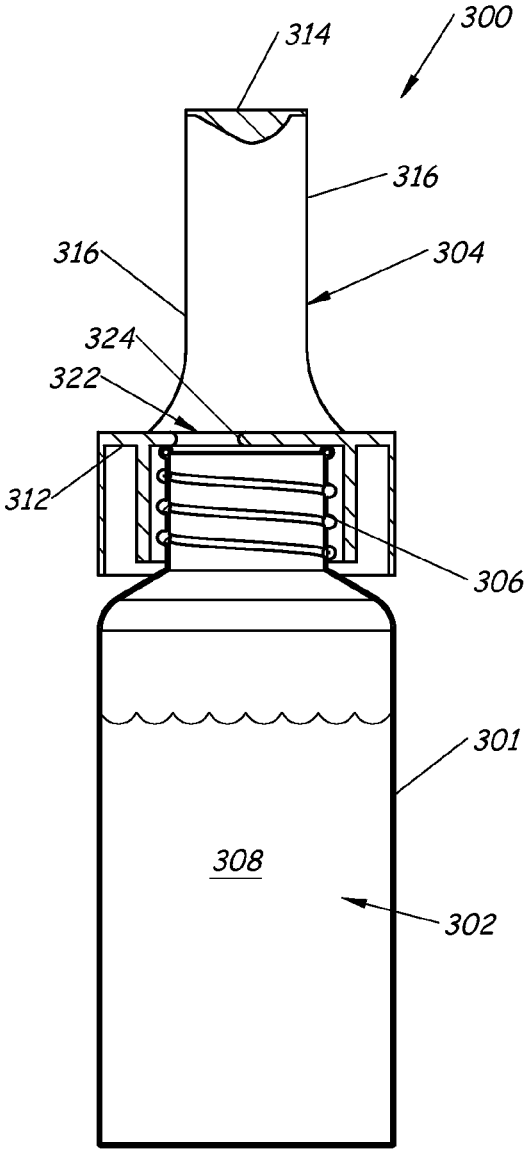
FIG. 13 is a section view of the beverage container illustrated in FIG. 11 taken along the line indicated in FIG. 12.

FIG. 11 is a perspective view of a beverage container 300 according to another embodiment. FIG. 12 is a front view of beverage container 300 and FIG. 13 is a section view of beverage container 300 taken through the line indicated in FIG. 12. Beverage container 300 includes a main body 301 that is made of a rigid material that has a primary reservoir or holder 302 (FIG. 13) and a storage compartment 304 (FIGS. 11-13) located external to the primary reservoir 300.

Primary reservoir 302 includes an opening 306 through which primary reservoir 302 can be filled with a first or primary fluid 308 (FIG. 13) and through which first or primary fluid 308 contained in primary reservoir 302 can be consumed by a user. Exemplary kinds of fluids that first fluid 308 may comprise are water and soda. However, other types of fluids including other types of liquid beverages, such as milk, are possible.

In the embodiment illustrated in FIGS. 11-13, not only is storage compartment 304 located external to primary reservoir 302, but storage compartment 304 is also located above primary reservoir 302 and is configured to be received by opening 306 in primary reservoir 302. Storage compartment 304 engages and disengages with opening 306 to also act as a cap to primary reservoir 302 in order to contain first fluid 308 within primary reservoir 302 and to fill and consume first fluid 308 from primary reservoir 302. A lower wall 312, upper wall 314 and at least one access opening 316 define storage compartment 304. In FIGS. 11-13, there are two access openings 316.

Storage compartment or cap 304 of beverage container 300 further includes a coupler 322 and a through port 324. In FIGS. 11 and 13, coupler 322 is integrally formed with lower wall 312 and is adapted to mate with a portion of peripheral container 250 that defines opening 252 (not illustrated in FIGS. 11-13). However, other types of mechanisms that could act to couple the portion of peripheral container 250 that defines opening 252 are possible. Through port 324 extends through lower wall 312 of cap 304. Through port 324 provides fluidic communication between storage compartment or cap 304 and primary reservoir 302. More specifically, through port 324 provides fluidic communication between peripheral container 250 and primary reservoir 302 to introduce the second fluid 254 into the first fluid 308.

Figure 14:
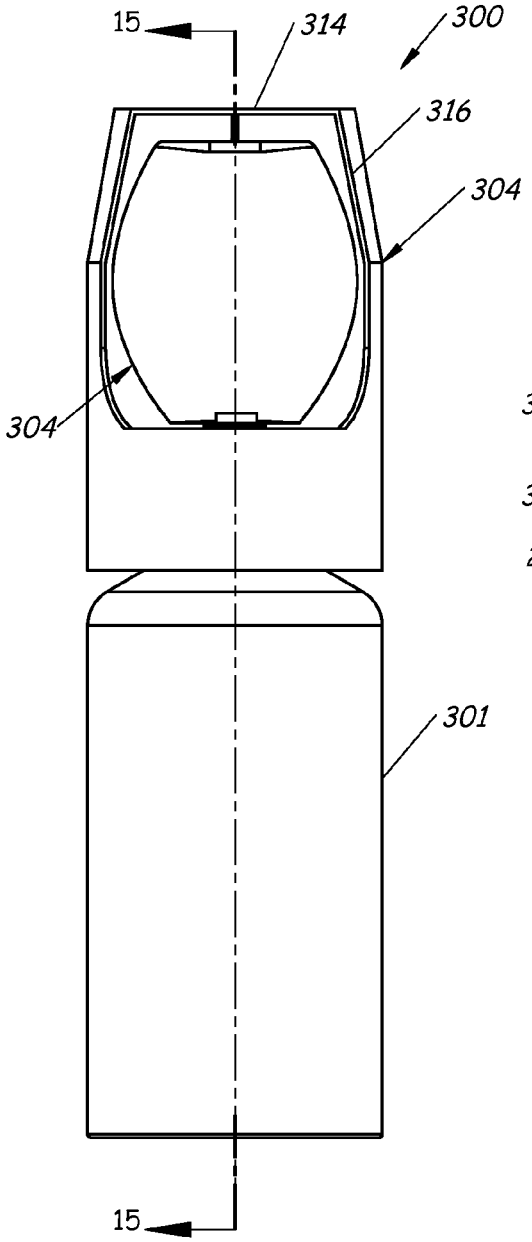
FIG. 14 is a front view of the beverage container illustrated in FIG. 1 with a peripheral container being located in a storage compartment in a cap of the beverage container.
Figure 15:
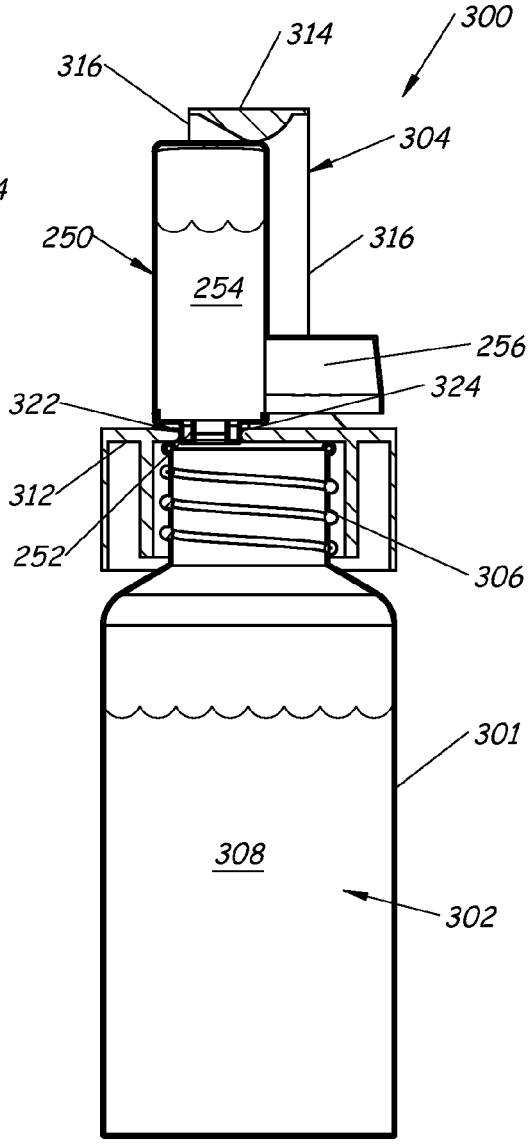
FIG. 15 is a section view of FIG. 14 taken along the line indicated in FIG. 14.

FIGS. 14 and 15 illustrate beverage container 300 including peripheral container 250 that is being stored in storage compartment or cap 304. FIG. 14 is a front view and FIG. 15 is a section view taken through the line indicated in FIG. 14. As previously described, peripheral container 250 is a container that contains a second fluid or secondary fluid 254 that has a different composition from a composition of first fluid 308. For example, peripheral container 250 includes a liquid beverage mix as also described above.

The at least one access opening 316 in storage compartment 304 allows for the receipt of and placement of peripheral container 250 in cap 304. Further, coupler 322 mates with the portion of peripheral container 250 that defines opening 252. In this way, coupler 322 holds the peripheral container 250 within storage compartment or cap 304. As illustrated in FIG. 15, peripheral container 250 includes a flip top cap 256. In a closed configuration, flip top cap 256 includes a portion that engages with opening 252 to provide protection against leakage through the dispensing nozzle. In an opened configuration, flip top cap 256 is rotatable about a hinge to separate from opening 252 so that fluid can be dispensed. To affix peripheral container 250 into storage compartment or cap 304, the portion of peripheral container 250 that defines opening 252 engages with coupler 322 and therefore through port 324 using a press-fit or interference connection. As illustrated in FIGS. 14 and 15, coupler 322 and therefore through port 324 can include a profile that receives the portion of peripheral container 250 that defines opening 252. However, other ways of connecting coupler 322 to opening 252 are possible.

To mix second fluid or secondary fluid 254 with first fluid or primary fluid 308, a user accesses peripheral container 250 through the at least one access opening 316. The user then squeezes to dispense or meter through opening 252 of peripheral container 250 and through port 324 an amount of second fluid 254 into primary reservoir 302.

Figure 16:
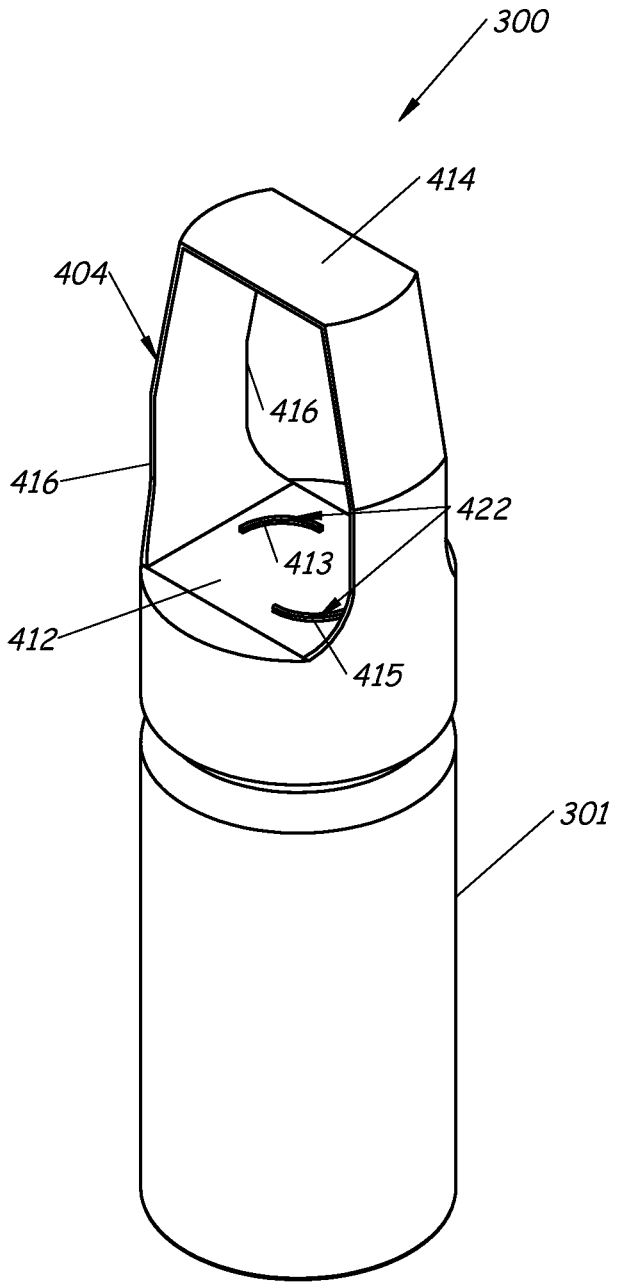
FIG. 16 illustrates a perspective view of the beverage container illustrated in FIG. 11 with an alternative cap according to another embodiment.
Figure 17:
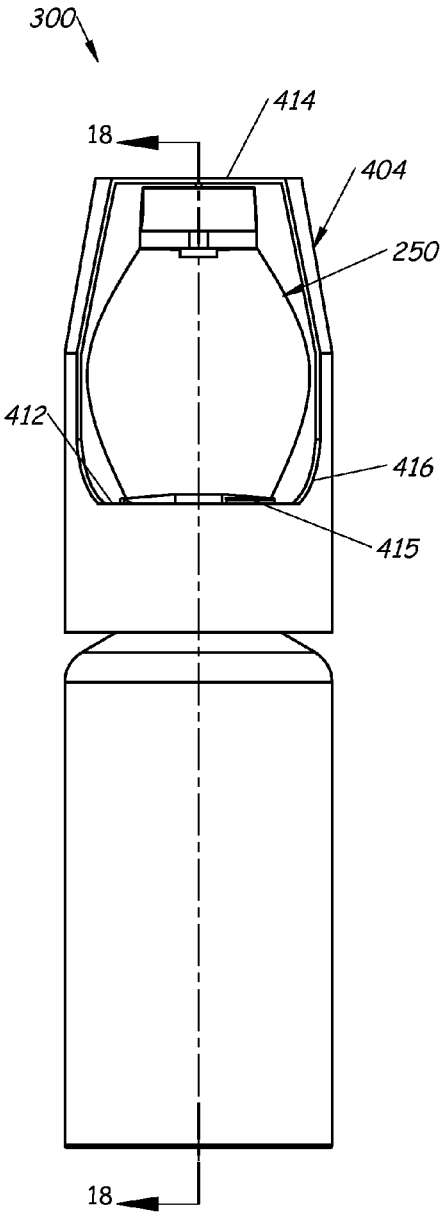
FIG. 17 is a front view of the beverage container illustrated in FIG. 16.
Figure 18:
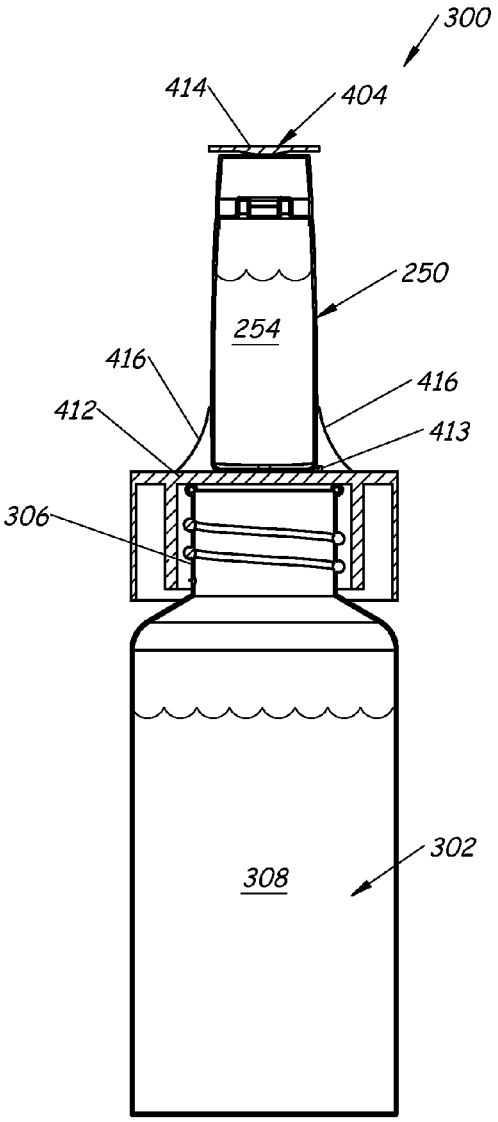
FIG. 18 is a section view of the beverage container illustrated in FIG. 16 taken along the line indicated in FIG. 17.

FIG. 16 is a perspective view of beverage container 300 having an alternative storage compartment or cap 404 according to another embodiment. FIG. 17 is a front view of this embodiment and FIG. 18 is a section view of this embodiment taken through the line indicated in FIG. 17. Storage compartment or cap 404 includes a lower wall 412, an upper wall 414 and at least one access opening 416. In FIGS. 16-18, there are two access openings 416.

Storage compartment or cap 304 further includes a coupler 422. In FIGS. 16-18, coupler 422 is integrally formed with lower wall 412 and is adapted to mate with a portion of the exterior housing of peripheral container 250 (not illustrated in FIGS. 16-18) to secure it within cap 404. However, coupler 422 can be formed with any wall of cap 404 to hold peripheral container 250 in place. In FIGS. 16-18, coupler 422 includes a plurality of protuberances 413 and 415 that protrude from an interior surface of lower wall 412 to hold and secure peripheral container 250 to the interior of storage compartment or cap 404 in an upwards orientation. Protuberances 413 and 415 are positioned opposite each other a distance that is substantially equal to a width or depth of peripheral container 250. In FIG. 16, protuberances are off-set from each other so that the bottom of peripheral container 250 can slide between the protuberances 413 and 415 and then lock into place. In the alternative or in addition to, coupler 422 can include a plurality of protuberance that protrude from an interior surface of upper wall 414 to hold and secure peripheral container 250 to the interior of storage compartment or cap 404 in an upwards orientation.

In one embodiment and as would be used in the embodiments illustrated in FIGS. 16-18, to mix second fluid or secondary fluid 254 with first fluid or primary fluid 308, storage compartment or cap 404 is removed from opening 306 in primary reservoir 302. Peripheral container 250 is removed from storage compartment 304 by extracting peripheral container 250 from coupler 422 or protuberances 413 and 415. However, it is possible that peripheral container 250 could first be removed from cap 404 and then cap 404 removed from opening 306. A user can then dispense second fluid 254 by, for example, squeezing peripheral container 250 so that second fluid 254 is metered through opening 306 using a dispensing nozzle 252 and into first fluid 308 located in primary reservoir 302.

Beverage containers 100 and 300 can be made from a variety of materials such as but not limited to, polymers, metals, metal alloys, glass, etc. Processes such as plastic injection molding, blow molding or other conventional machining or manufacturing processes could be used to manufacture beverage containers 100 and 300. A secondary manufacturing process, such as but not limited to adhesive bonding, welding, molding or a compression fit could be used to install and fixedly attach valve assembly 126. A secondary process to install coupler 122 with wall 112, coupler 322 with lower wall 312 and coupler 422 with lower wall 412 can be used, such as, but not limited to, adhesive bonding, welding, molding or a compression fit.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A beverage container comprising:

a primary reservoir adapted to hold a first fluid, the primary reservoir being accessible through an opening for filling the primary reservoir with the first fluid and for consuming the first fluid;

a storage compartment located external to the primary reservoir;

a coupler attached to a wall that defines at least a portion of the storage compartment, the coupler adapted to mate with a portion of a peripheral container so that the peripheral container is housed in the storage compartment;

wherein the peripheral container holds a second fluid having a composition that is different from a composition of the first fluid; and wherein an inside of the storage compartment is viewable to a surrounding environment so that at least one exterior surface of the peripheral container is exposed for viewing when the peripheral container is housed in the storage compartment.

2. The beverage container of claim 1, wherein the storage compartment is located below the primary reservoir.

3. The beverage container of claim 1, wherein the wall that defines at least a portion of the storage compartment and includes the coupler is a shared wall that also defines at least a portion of the primary reservoir.

4. The beverage container of claim 1, wherein the storage compartment is located above the primary reservoir.

5. The beverage container of claim 1, wherein the storage compartment comprises a cap that mates with the opening in the primary reservoir.

6. The beverage container of claim 1, wherein the coupler is integrally formed with the wall of the storage compartment.

7. The beverage container of claim 1, wherein the coupler comprises at least one protuberance that protrudes from the wall of the storage compartment.

8. The beverage container of claim 1, further comprising a through port that extends through the wall and aligns with the coupler, the through port providing fluidic communication between the peripheral container and the primary reservoir to introduce the second fluid into the first fluid.

9. The beverage container of claim 8, further comprising a valve assembly configured to block the first fluid from exiting the primary reservoir through the through port in the wall when the beverage container is in the upright position and configured to release from blocking the through port in the wall when the beverage container is inverted to allow the second fluid to be dispensed from the peripheral container.

10. The beverage container of claim 9, wherein the valve assembly comprises a ball stopper.

11. A beverage container comprising:

a primary reservoir that contains a primary fluid;

a storage compartment located external to the primary reservoir; and a coupler attached to a wall that defines at least a portion of the storage compartment and is adapted to mate with a portion of a peripheral container so that the peripheral container is housed in the storage compartment, the peripheral container containing a secondary fluid; and wherein an inside of the storage compartment is viewable to a surrounding environment so that at least one exterior surface of the peripheral container is exposed for viewing when the peripheral container is housed in the storage compartment.

12. The beverage container of claim 11, wherein the wall that defines at least a portion of the storage compartment comprises a shared wall that also defines at least a portion of the primary reservoir.

13. The beverage container of claim 11, wherein the storage compartment is located above the primary reservoir.

14. The beverage container of claim 11, wherein the primary reservoir comprises an opening for filling the primary reservoir with the primary fluid and for consuming the primary fluid.

15. The beverage container of claim 14, wherein the storage compartment comprises a cap that mates with the opening in the primary reservoir.

16. The beverage container of claim 15, wherein the cap comprises the storage compartment.

17. A beverage container comprising:

a primary reservoir including an opening for filling the primary reservoir with a primary fluid and for consuming the primary fluid;

a storage compartment located external to the primary reservoir;

a coupler attached to a wall that defines at least a portion of the storage compartment;

a peripheral container stored in the storage compartment of the beverage container by mating a portion of the peripheral container with the coupler, wherein the peripheral container holds a secondary fluid and the secondary fluid is removed from the storage compartment to dispense the secondary fluid into the primary fluid through the opening by squeezing the peripheral container, the primary fluid has a composition that is different from a composition of the secondary fluid;

wherein an inside of the storage compartment is viewable to a surrounding environment so that at least one exterior surface of the peripheral container is exposed for viewing when the peripheral container is stored in the storage compartment.

18. The beverage container of claim 17, wherein the storage compartment is located above the primary reservoir.

* * * * *